US005645140A

United States Patent [19]

Mouneimneh

[11] Patent Number: 5,645,140

[45] Date of Patent: Jul. 8, 1997

[54] SELF-SUPPORTED COLLAPSIBLE LADDER

[76] Inventor: Ghassoub A. Mouneimneh, 81 Independence Rd., Feeding Hills, Mass. 01030

[21] Appl. No.: 437,618

[22] Filed: May 8, 1995

[51] Int. Cl.[6] ..... E06C 1/00

[52] U.S. Cl. ..... 182/195; 182/180.3

[58] Field of Search ..... 182/195, 180, 182/107, 166, 167, 168, 209

[56] References Cited

U.S. PATENT DOCUMENTS

| | | | |
|---|---|---|---|
| 595,453 | 12/1897 | Fischer | 182/195 |
| 1,381,397 | 6/1921 | Briles | 182/180 |
| 1,812,119 | 8/1931 | Ruse | 182/180 |
| 2,186,119 | 1/1940 | Moen | 182/169 X |
| 2,194,856 | 3/1940 | Kostuk | 182/195 X |
| 2,542,398 | 2/1951 | Crumpton | 182/195 |
| 4,147,231 | 4/1979 | Chantler et al. | 182/107 X |
| 5,370,204 | 12/1994 | Fox | 182/180 X |
| 5,495,915 | 3/1996 | Weston et al. | 182/195 |

FOREIGN PATENT DOCUMENTS

| | | | |
|---|---|---|---|
| 223555 | 11/1957 | Australia | 182/195 |
| 614874 | 10/1959 | Canada | 182/195 |
| 593953 | 5/1959 | Italy | 182/195 |
| 8502440 | 6/1985 | WIPO | 182/166 |

*Primary Examiner*—Daniel P. Stodola
*Assistant Examiner*—William A. Rivera

[57] ABSTRACT

A self-supporting collapsible ladder comprising a plurality of ladder sections with pin-locking mechanisms which secure adjacent ladder sections into an extended position. The ladder has a mechanism for self-supporting the ladder assembly by the use of braces attached to the ladder which are rotated and held in place by support rails which can be extended when in use.

5 Claims, 5 Drawing Sheets

7
8
IV
V
V
IV
4
6
2
3
1
15
5
23
16
17
16A

SELF-SUPPORTED COLLAPSIBLE LADDER

FIELD OF THE INVENTION

The present invention relates to the field of collapsible ladders. More particularly, the invention relates to a ladder which can be collapsed for storage and transport in small places and can be elongated to a wide variety of lengths for home or commercial use. The invention also has a self-supporting means so that it does not need to be placed against any other object for support.

BACKGROUND OF THE INVENTION

There have been many previous attempts to invent ladders which can be collapsed for easy storage and elongated for use. Many of these ladders, including U.S. Pat. Nos. 4,884,659, 4,442,920, 4,678,060, 4,852,688, and 4,595,075, present collapsible ladders but their principle function is limited to emergency use as escape ladders. Most of the ladders in the prior art do not contain the structural support necessary for general household or industrial use.

Moreover, the prior art does not disclose any collapsible ladder which can be adjusted to any specific height depending on the purpose for which the ladder is to be used. In addition, no existing collapsible ladder discloses a convenient pin-locking mechanism used to adjust the height of the ladder similar to the present invention. Furthermore, no other collapsible ladder has a means for self-support such as the instant invention. As a result, the present invention possesses versatility not previously seen in a ladder of any type.

OBJECT OF THE INVENTION

An object of the present invention is to provide an improved collapsible ladder.

Another object is to provide a ladder which is extremely portable.

A further object is to provide a ladder which can be stored and transported in small spaces.

A still further object is to provide a collapsible ladder that can be opened or closed section by section from the ground or from an elevated position.

Another object of the invention is to provide a collapsible ladder that is structurally solid.

Another object is to provide such a ladder that is self-supporting.

Another object of the invention is to provide such a ladder that is safe.

Yet another object of the invention is to provide such a ladder with improved design.

BRIEF SUMMARY AND ABSTRACT OF THE INVENTION

According to the present invention, the foregoing and other objects are attained by the combination of several ladder sections each consisting of two parallel, hollow side rails which are cylindrical in shape. The side rails are topped by a generally rectangular shaped rung. The rungs have round holes in the top which allow for the passage and connection of side rails from adjacent ladder sections. The side rails from each ladder section are slightly smaller in diameter than the subjacent section. Adjacent ladder sections are connected by sliding the side rails of one section into the side rails of the subjacent section.

The ladder sections are locked into an open or extended position by a pin-locking mechanism located on the underside of each rung. When a ladder section is extended, a hole near the bottom of the subject side rail section is aligned with a hole near the top of the subjacent side rail section. A pin is automatically pushed by a spring through the two holes when the holes are aligned, thereby locking the adjacent ladder sections safely in place. The ladder section can be lowered by pulling the pin mechanism back through the holes, thereby unlocking the sections and allowing the subjacent section to close by force of gravity.

In accordance with another aspect of the invention, the ladder contains a means for self-support. The support section of the ladder contains two braces which are attached to the bottom section of the ladder and which rotate into place when in use. The support section of the ladder also contains two collapsible support rails which are parallel and are connected at their ends by a cross bar. The support rails are connected at the opposite ends by a connector piece which is pivotally attached to the ladder below the braces. The pivotal connection allows the support rails to be raised for storage or lowered for use. The support braces are held in place by rotating them forward into an open position and lowering them into brackets mounted on the tops of the support rails.

When the support means is in use the ladder automatically leans slightly forward so the ladder is placed in a position such that the center of gravity of the person using the ladder will be above the support means to ensure stability. The ladder can also be used without the self-support means by simply leaning the ladder against a wall like a conventional extension ladder.

Other advantages of the present invention will become readily apparent to those skilled in this art from the following detailed description, wherein only the preferred embodiment of the invention is shown for carrying out the present invention. It will be realized that the invention is capable of other embodiments and its details are capable of design modifications without departing significantly from the invention. Accordingly, the drawings and description are to be regarded as illustrative in nature, and not as restrictive.

DESCRIPTION OF THE PREFERRED EMBODIMENT

Figure 1:
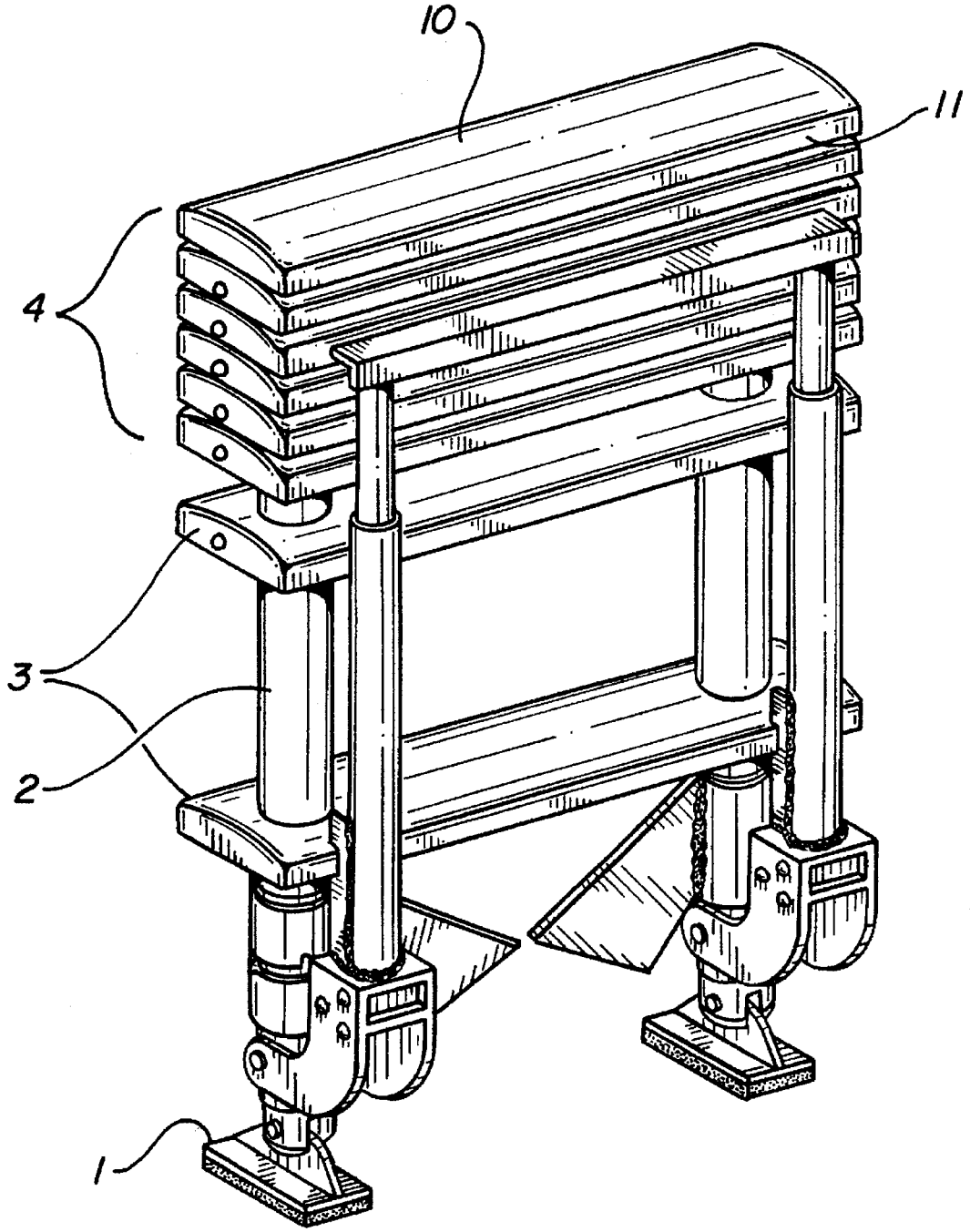
FIG. 1 is a perspective view of the collapsible ladder in accordance with the preferred embodiment of the invention and shown in a closed position.
Figure 2:
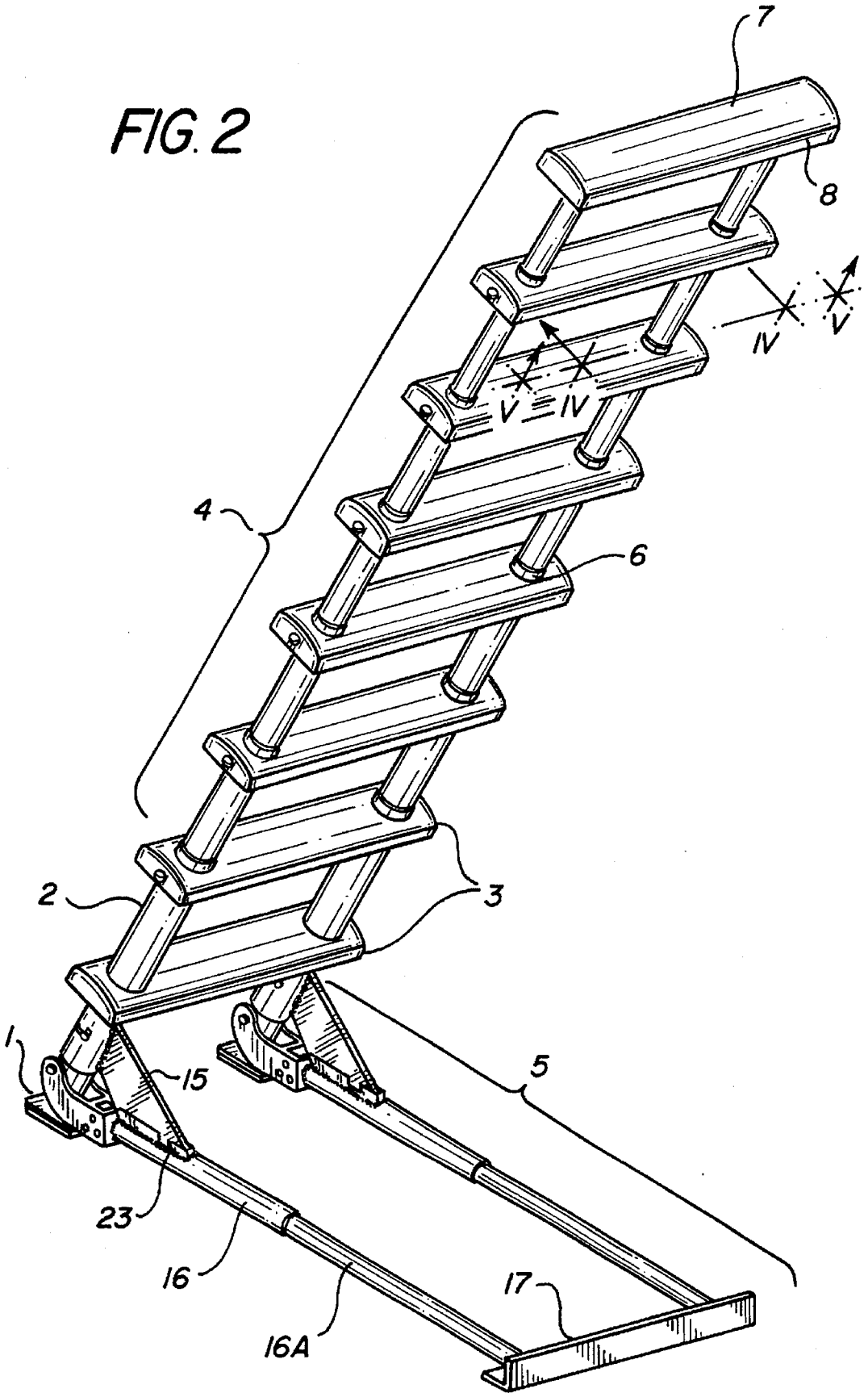
FIG. 2 is a perspective view of the collapsible ladder in an open and self-supporting position.

With reference to FIGS. 1 and 2, the present invention consists of a collapsible ladder and a support means. The ladder includes a bottom section with two support feet 1 pivotally attached by means of a pin to the bottoms of two parallel, hollow and cylindrically shaped side rails 2. The bottom section of the ladder has two rungs 3. One of the rungs is affixed to the rails in the middle of the section and the other is affixed to the top of the rails.

Figure 4:
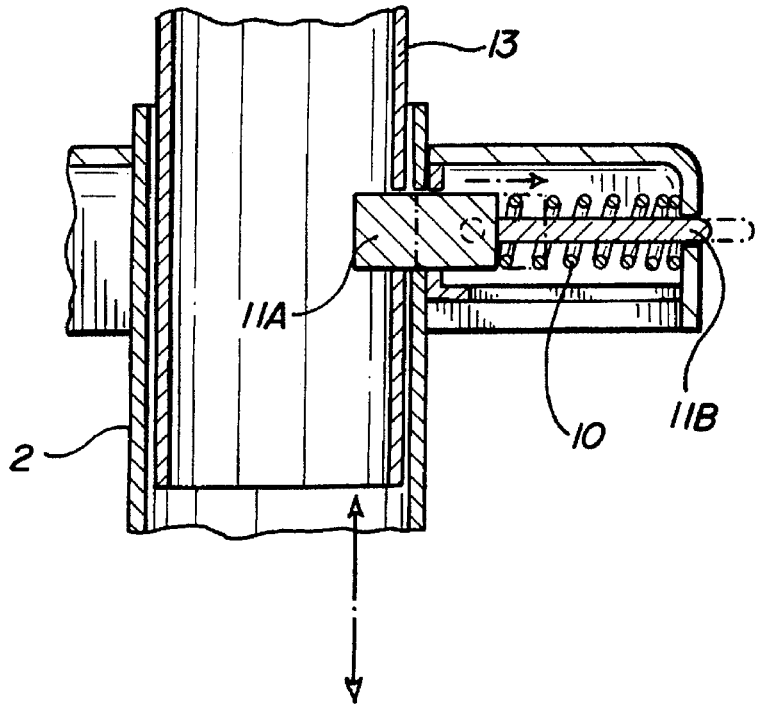
FIG. 4 is a cross sectional view of the pin locking mechanism as viewed along line IV—IV from FIG. 2.

The invention contains a plurality of ladder sections 4 which can be raised and locked to open or extend the ladder to the desired height (FIG. 2) or lowered to a closed position (FIG. 1) for storage or transport. Each ladder section contains two parallel, hollow rails 2 and a rung affixed at the top and perpendicular to the rails. The rails extend through the rung and are affixed to circular sleeves 6 which are in turn affixed to the rungs to add stability. Each rail section is open at the top and bottom, is of an equal length, and is of a diameter such that the subject rail 13 fits inside the rail 2 of the ladder section next below the subject ladder section (FIG. 4). The length of the rails is such that when a section is locked in an open position a person can comfortably step from one rung to the rung next above or below the subject rung.

The rungs are generally rectangular in shape when viewed from above. Each rung other than the top rung 7 has holes and sleeves 6 for receiving the ladder rails. The rungs have a lip 8 extending downward from each side but are open at the bottom. The height of the lip is approximately equal to the height of the sleeve 6 such that when the subject section is closed the bottom of the rung contacts the top of the rung below.

Figure 3:
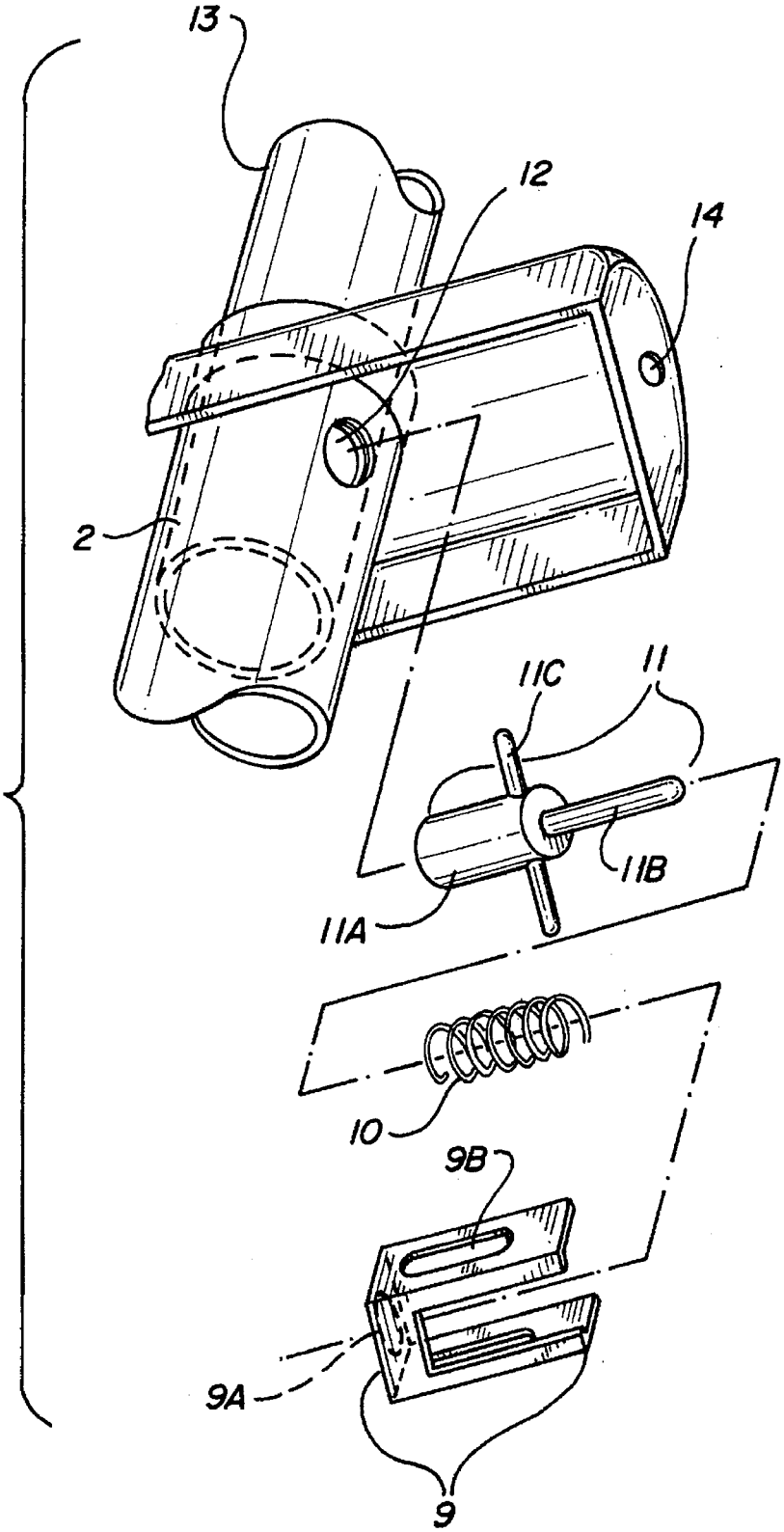
FIG. 3 is an exploded view of the pin locking mechanism.
Figure 5:
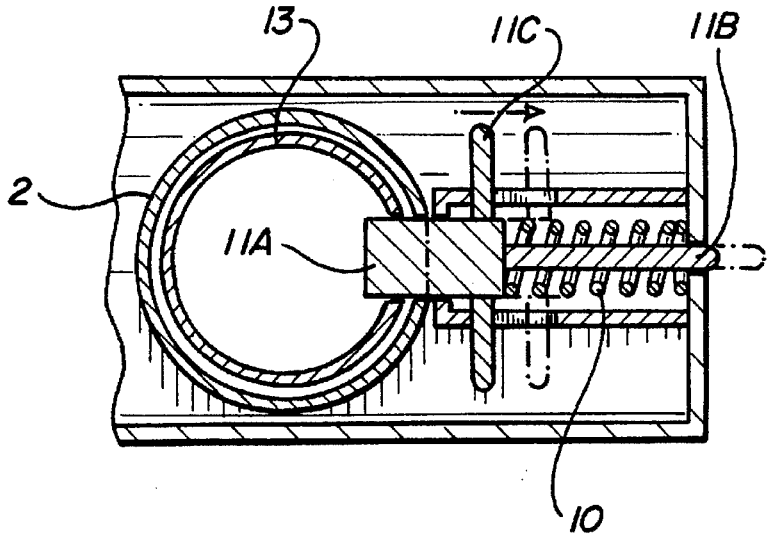
FIG. 5 is a cross sectional view of the pin locking mechanism as viewed along line V—V from FIG. 2.

A pin mechanism which is used to lock each section in position is located under each end of every rung FIGS. 3, 4 and 5. The pin mechanism consists of a bracket 9 which houses a spring 10 and a pin 11. The bracket is comprised of two ends and two sides. The bracket is generally U-shaped as viewed from below. The bracket is affixed to the underside of the rung and extends from the ladder rail at one end (the rail end) to the lip of the rung at the other end (the rung end). The bracket has a hole 9A through the rail end which aligns with hole 12 in the attached ladder rail and can be aligned with a hole 12 near the bottom of the ladder rail from the ladder section next above the subject section. The two sides of the bracket are slotted 9B and are identical to one another. The rung end of the bracket is open.

The pin 11 is generally in the shape of a cross with one end (the rail end) 11A being of larger diameter than the opposite end (the rung end) 11B. By force of the spring 10, the rail end of the pin is automatically extended through the hole 12 in adjacent rail sections to lock the section next above 13 in an open position when the holes are brought into alignment (FIGS. 4 and 5).

The pin arms 11C extend radially from the rail end of the pin and are positioned through the slots 9B on the sides of the bracket. A spring 10 is positioned over the rung end of the pin 11B and against the rail end of the pin (FIGS. 4 and 5). When the pin arms are pulled to unlock the ladder the rung end of the pin passes through a hole in the lip of the rung 14 as shown in FIGS. 4 and 5. In order to unlock and lower the ladder section above, a person reaches below each end of the rung and pulls the pin arms 11C toward the rung ends, thereby removing the pin from the rail holes 12 and allowing the upper section of the ladder to be lowered by force of gravity. A person is always able to determine whether a ladder section is safely in a locked position because the pin can be seen protruding through a hole in the side of the rung 14 if the ladder is not in a locked position.

Figure 6:
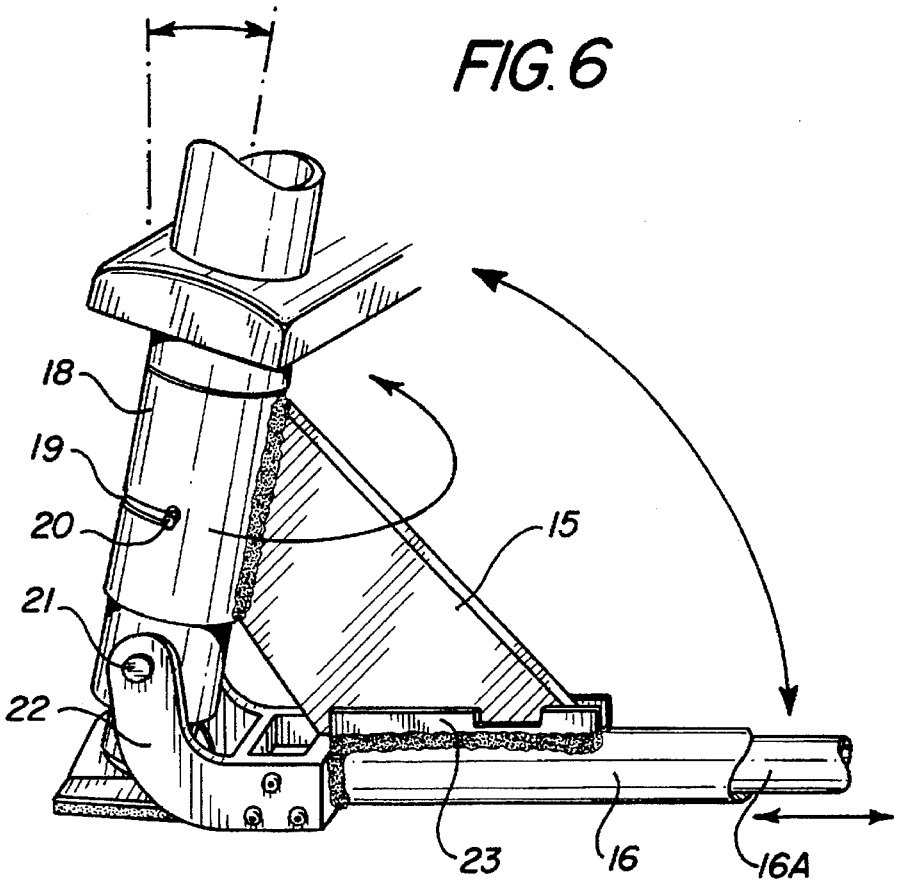
FIG. 6 is a detailed view of the ladder support means in an open position.
Figure 7:
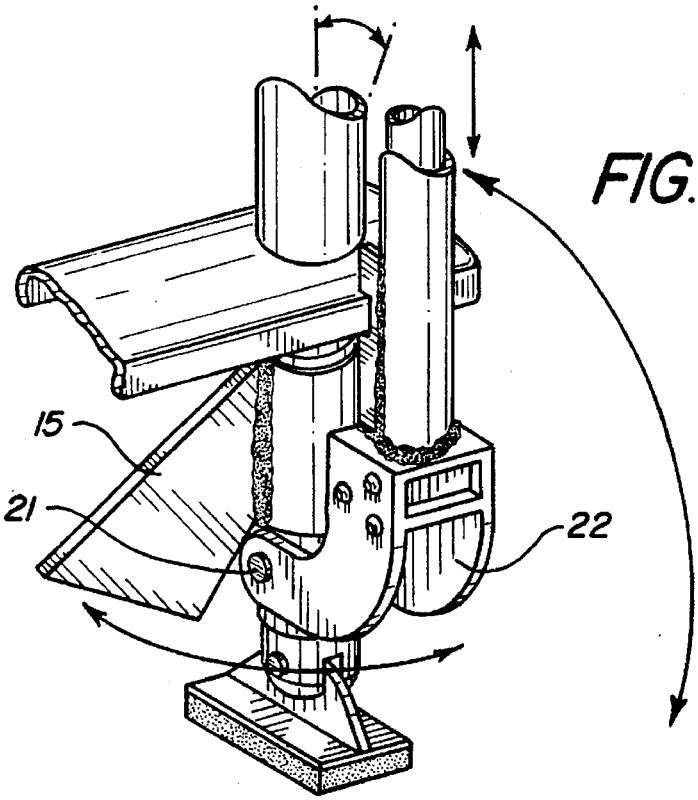
FIG. 7 is a detailed view of the ladder support means in a closed position.

The ladder can be used with or without its means of self-support. The support section 5 of the ladder consists of two support braces 15 and two collapsible support rails 16 which lie parallel to one another and are connected at the end by a cross bar 17. The support braces 15 are attached below the bottom rung of the ladder by means of a cuff 18 which encircles the ladder rail below the bottom rung. The braces 15 can be rotated ninety degrees by means of a horizontal slot 19 in the cuff and a pin 20 protruding from the outer side of each ladder rail. The slot 19 curves sharply upward at each end such that the brace drops into a locked position when the brace 15 is rotated to either an open position (FIG. 6) or a closed position (FIG. 7). The brace faces forward in an open position and is rotated ninety degrees inward toward each other when in a closed position as illustrated in FIG. 7.

The support rails 16 are pivotally connected to the ladder rails below the cuff by means of a pin 21 which passes through the ladder rail and a support rail connector 22. The support rail connector 22 can thereby pivot in an upward manner to close the support means for storage (FIG. 7) or in a downward manner to open the support means for use (FIG. 6). The support rails 16 have affixed at the end nearest the connector a support bracket 23 affixed to the top of each support rail 16. Said brackets 23 have two sides and are open at the top. The support brackets 23 hold the support braces 15 securely in place when the brace and support rails are in an open position (FIG. 6). Each support rail consists of two smaller rails 16 and 16A one of which is of smaller diameter 16A so that it slides into the larger rail 16 for closure (FIG. 1) and can be extended outward when the support means is open (FIG. 2). The support rails are connected at the end opposite the ladder by a cross bar 17 which is generally L-shaped.

The self-support means is utilized by rotating the support braces 15 into an open position, extending the support rails 16 and 16A into an elongated position and leaning the ladder slightly forward such that the support braces 15 are pivoted into the support brackets 23.

What is claimed is:

1. A collapsible ladder assembly comprising:

a lower section having two ends and a mid-point, two pivotally attached support feet at one end, two side rails substantially parallel to each other and attached to two transversely extending rungs, wherein one of said rungs is attached to the opposite end of said rails and the other is attached at the mid-point of said rails of the lower section;

a plurality of ladder sections each having two side rails which are open at each end and are affixed at one end through a perpendicular rung and sleeves, said side rails being of equal length and of varying width wherein the width of the side rails of any given ladder section are slightly greater than the width of the side rails of the superjacent ladder section such that the superjacent ladder section slides freely within the side rails of the given ladder section and nests therein when the ladder is in a closed position;

a pin mechanism attached to an underside of each rung, said pin mechanism being a means for locking adjacent ladder sections in an open position and for unlocking or closing the superjacent ladder section of any ladder section; said pin mechanism being comprised of a housing bracket, a pin, and a spring; and whereby said spring forces said pin through a hole in the ladder section side rail and an aligned hole in the side rail of the superjacent ladder section, thereby locking the ladder sections in an open and extended position; and whereby the ladder sections are released or closed by pulling the pin out of said holes, thereby collapsing the ladder sections; and a means for making the ladder self-supporting having a support brace attached to each side rail at the lower section of the ladder below the lowest rung by means of cuffs which encircle said rails and rotate 90° such that the braces extend from the cuffs to the support rail when open and in use and inward or toward each other when closed or not in use and a support rail connector pivotally attached to each rail below said cuffs, said support rail connectors having two substantially parallel support rails extending therefrom, which are connected at the opposite end by a perpendicular cross rail.

2. A ladder according to claim 1 wherein said cuffs are secured to said rails by means of a pin which passes through a horizontal slot in each of said cuffs, said slots being curved sharply upward at each end.

3. A ladder according to claim 1 wherein said support rail connectors are pivotally attached to the side rails by means of a pin.

4. A ladder according to claim 1 wherein each of said support rails is comprised of two telescoping rails; each of said telescoping rails is connected at one end to said support rail connectors and is open at each opposite end; and, a second telescoping rail, of a smaller width, which is connected at one end to a cross rail and is open at the other end such that it nests in the larger rail when not in use and is adapted to be extended when in use.

5. A ladder according to claim 1 wherein said cross rail is generally L-shaped.

* * * * *